US006726573B2

(12) United States Patent
Edge

(10) Patent No.: US 6,726,573 B2
(45) Date of Patent: Apr. 27, 2004

(54) POOL CHALK RECOVERY SYSTEM

(76) Inventor: Jesse J. Edge, 6294 Reynolds Ridge Rd., Potosi, WI (US) 53820

( * ) Notice: Subject to any disclaimer, the term of this patent is extended or adjusted under 35 U.S.C. 154(b) by 0 days.

(21) Appl. No.: 10/127,928

(22) Filed: Apr. 23, 2002

(65) Prior Publication Data

US 2002/0165035 A1 Nov. 7, 2002

Related U.S. Application Data

(60) Provisional application No. 60/287,827, filed on May 1, 2001.

(51) Int. Cl.[7] ..... A63D 15/16; A63B 67/00

(52) U.S. Cl. ..... 473/35; 473/49

(58) Field of Search ..... 473/35–39, 44–49, 473/50, 51; 273/443, 138.2, 142 JB, DIG. 30

(56) References Cited

U.S. PATENT DOCUMENTS

| | | | | | |
|---|---|---|---|---|---|
| 133,603 | A | * | 12/1872 | Thomas | 473/36 |
| 173,996 | A | * | 2/1876 | Phillipson | 473/36 |
| 199,321 | A | * | 1/1878 | Seymer | 473/49 |
| 437,746 | A | * | 10/1890 | Barber | 473/36 |
| 507,471 | A | * | 10/1893 | Barger | 473/36 |
| 601,779 | A | * | 4/1898 | Roberts | 473/36 |
| 606,744 | A | * | 7/1898 | St. John | 273/239 |
| 773,189 | A | * | 10/1904 | Bourget et al. | 473/36 |
| 939,156 | A | * | 11/1909 | Norman et al. | 473/36 |
| 1,468,520 | A | * | 9/1923 | Seeman et al. | 473/49 |
| 1,563,467 | A | * | 12/1925 | Canias | 473/49 |
| 2,590,002 | A | * | 3/1952 | Frazier | 273/108 |
| 2,628,096 | A | * | 2/1953 | Bell | 473/36 |
| 3,214,171 | A | * | 10/1965 | Luchsinger | 273/108.5 |
| 3,940,135 | A | * | 2/1976 | Cohen | 273/108.5 |
| 4,049,275 | A | * | 9/1977 | Skelton | 273/239 |
| 4,172,597 | A | * | 10/1979 | Smith et al. | 273/239 |
| 4,398,893 | A | * | 8/1983 | Johns | 434/305 |
| 4,718,671 | A | * | 1/1988 | Desmond et al. | 473/48 |
| 4,858,926 | A | * | 8/1989 | Cabianca | 473/47 |
| 4,949,964 | A | * | 8/1990 | Jolly | 473/48 |
| 5,039,099 | A | | 8/1991 | Bravo | |
| 5,046,728 | A | | 9/1991 | Haddock | |
| 5,083,733 | A | * | 1/1992 | Marino et al. | 248/110 |
| 5,328,411 | A | | 7/1994 | Thornton, II | |
| 5,356,345 | A | * | 10/1994 | Peuplie et al. | 473/36 |
| 5,382,196 | A | | 1/1995 | Lodrick | |
| 5,407,197 | A | | 4/1995 | Parsons | |
| 5,462,490 | A | * | 10/1995 | Donwen | 473/49 |
| 5,782,693 | A | * | 7/1998 | Jordan et al. | 473/48 |
| 6,251,024 | B1 | * | 6/2001 | Summers et al. | 473/49 |

* cited by examiner

*Primary Examiner*—Steven Wong
*Assistant Examiner*—Mitra Aryanpour
(74) *Attorney, Agent, or Firm*—Leydig, Voit & Mayer, Ltd.

(57) ABSTRACT

The invention provides a system associated with the games of pool and billiards for the recovery of a chalk cube from a position of repose on any of the rails that define a pool-playing surface or other surfaces in the playing environment. The system or combination broadly comprises a chalk cube fabricated with a material of a first kind such as a paramagnetic material that is subject to engagement and retention with a material of a second kind such as a permanent magnet material incorporated near the tip end of a cue. The player using the cue of this invention can reach a chalk cube constructed in accordance with this invention and engage and retain the cube against a portion of the cue in the proximity of the tip end for recovery and use in the course of play.

14 Claims, 2 Drawing Sheets

POOL CHALK RECOVERY SYSTEM

REFERENCE TO RELATED PATENT APPLICATION

This patent application claims the benefit of U.S. Provisional Patent Application No. 60/287,827 filed on May 1, 2001.

FIELD OF THE INVENTION

This invention pertains to accessories that pool and billiard players will find useful, and particularly, to accessories that facilitate player access to a chalk cube during play. More particularly, this invention relates to a chalk cube recovery system comprising a combination of a unique pool cue and a unique chalk cube whereby the player can easily engage, recover, retain and utilize a chalk cube with a minimum interruption of play or inconvenience.

BACKGROUND OF THE INVENTION

The invention provides a system useful to pool and billiard players and any other participant in a game utilizing pool cues with a leather or similar tip, the performance of which is optimized by scuffing and the use of chalk. The terms "pool table, 'pool cue', 'pool player' or the like will be used throughout the specification to refer to tables, cues, players and the like involving playing surfaces in the nature of a pool table or billiard table and related items.

Pool tables are classified in a variety of sizes or other categories for a variety of applications depending in part on room size. One such classification includes: Bar Size tables, generally about 7 feet long and 3.5 feet wide; Home Size tables, approximately 8 feet long and 4 feet wide; Commercial Size, about 8.5 feet long and 4.25 feet wide; and Tournament Size, about 9 feet long and 4.5 feet wide. Cues for use with pool tables (pool cues) also vary in length depending in part on the size of the table with which they are employed. One accepted length for pool cues is 48 inches. For larger tables a 58 inch pool cue is common.

Cues are generally circular in cross section and tapered from a large player or gripping end to a much smaller striking or tip end. At the tip end there is a tip usually of leather and about ½ inch in diameter that is scuffed to a desired configuration and chalked for optimum engagement with the balls used on the pool table (pool balls). The tip is secured to the cue by a ferrule which usually has a diameter of ½ inch or larger and may be fabricated from metal including aluminum, brass, steel or from a variety of alloys. Ferrules are also molded in copolymers, fiber resins or the like.

In the course of play a player regularly wishes to apply chalk to the cue tip to maintain the optimum and consistent striking characteristics of the tip with the pool balls. For this purpose, a rectangular cube of chalk is normally maintained on or near the pool table or on the person of a player. Many players utilize the chalk before each shot. One conventional chalk cube is 1 by 1 by 1 inch with a slight indentation on one of the surfaces (the top) which comprises the working surface. The remaining five surfaces are at least partially covered with some material such as paper for ease of handling and for aesthetic, cleanliness and source identification purposes.

Because of the size of pool tables and the space required in the room for maneuvering, it is often difficult to have a chalk cube readily available to a player prior to each shot. Many players prefer to have a chalk cube of their own and do not merely rely on the chalk cubes of others or chalk generally available in the surrounding area.

For the foregoing reasons, various techniques and devices have been proposed for use by a pool player to maintain easy access to his chalk cube. One such device is a personal chalk holder shown and described in U.S. Pat. No. 5,382,196 which includes a spring activated spool of line to which a chalk cube is attached and which has a connector for attachment to an article of clothing worn by a player. Another proposed solution to the need for quick personal access to a chalk cube is shown and described in U.S. Pat. No. 5,046,728 entitled "Chalk Holder and Scuff Gauging Device." In that patent a plate is provided having a serrated scuffing surface and a chalk holder. The chalk holder supports a chalk cube and has a magnetic base that is detachably secured to the plate member. The plate member includes a clip for securing the plate to the clothing of a user. Still another proposal for attaching a chalk cube to a player's clothing is shown and described in U.S. Pat. No. 5,328,411 entitled "Billiard Cue Chalk Holder." The chalk holder includes a magnet on the bottom surface thereof and is intended to provide a pressure fit between the sidewalls of the holder when the chalk is inserted in the open top. The chalk can then be attached to a metal surface such as a plate under a pool table or a key chain worn by the pool player. The patent also describes a clip that can be attached to a player's belt or shirt pocket during play.

None of the foregoing provides an optimum structure, system, arrangement or method for maintaining a chalk cube readily available without interfering with the player's activities or soiling the player's clothing.

BRIEF SUMMARY OF THE INVENTION

This invention provides a system for the recovery of a chalk cube from its position of repose on any of the rails that define the pool-playing surface or other surfaces in the playing environment. The system or combination broadly comprises a chalk cube fabricated with a material of a first kind that is subject to engagement and retention when in engagement with a material of a second kind. The system also includes a cue having a tip end with a material of the second kind disposed in proximity to the tip. The player using the cue of this invention can reach a chalk cube made in accordance with this invention and engage and retain the cube adjacent the tip end of the cue. This occurs as a result of the mutual engagement and retention between the material of the first kind and the material of the second kind. When the player extends his arm holding the cue near the gripping end, he can readily reach his chalk cube on the rails of the pool table or the nearby surfaces. Various embodiments of the invention will be described hereinafter.

One of the preferred embodiments of the invention provides a sheet of paramagnetic material such as soft iron or steel at least partially surrounding the chalk cube. This sheet comprises a magnetic material of the first kind. This preferred embodiment also includes a permanent magnet of high retentivity, that is, a ferromagnetic material that maintains a magnetic field without the aid of external electric current. The material is preferably a sintered neodymium-iron-boron material incorporated in the striking end of the cue in proximity to the tip. This material comprises a magnetic material of the second kind. This system enables a player to recover a chalk cube that is readily engaged and retained by the cue tip. Moreover, an advantage of using magnetic materials in this manner in practicing the invention is the attractive power of a magnetic field. In use, the chalk will be drawn to the cue tip from a short distance away. While the chalk cube is retained the player can draw the tip and chalk back to a position where he can easily grasp the cube with his free hand and utilize it for preparing the tip of his cue for the next shot.

A magnetic material of the second kind can be incorporated in both the chalk cube and the cue and thus obtain even greater attraction therebetween. However, the increased attraction usually will not add sufficient benefit to justify additional expense or manufacturing cost. For purposes of fully understanding this invention, it should be understood that the magnetic material of the first kind includes both paramagnetic material and permanent magnetic material.

DETAILED DESCRIPTION OF THE INVENTION

Figure 1:
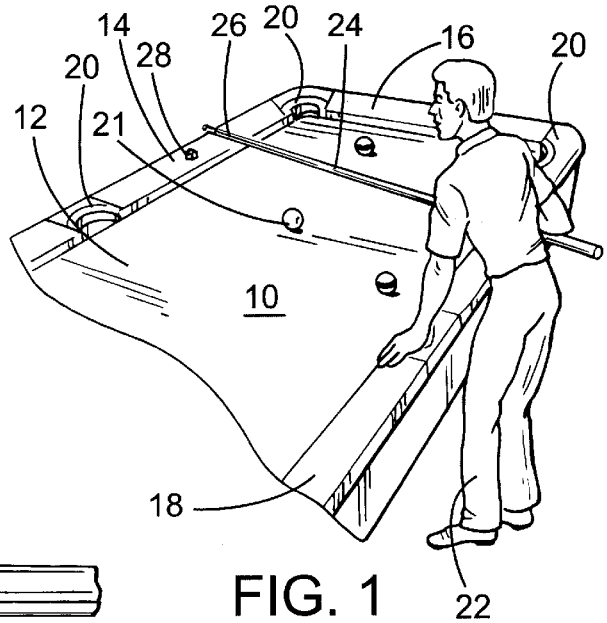
FIG. 1 is a fragmentary perspective view of a pool table with balls on the playing surface, a chalk cube on the rail and a player holding a cue stick.

Referring now to the drawings and more particularly to FIG. 1, the principal and basic elements of the combination comprising the invention are shown. A fragment of a pool table 10 is illustrated including a playing surface 12 and rails 14, 16 and 18. Corner and side pockets 20 and pool balls 21 are shown on the playing surface 12. A player 22 is illustrated holding a cue 24 with a tip portion 26. Shown on rail 14 is a chalk cube 28 that is disposed in a typical location experienced during pool or billiards play. In accordance with the invention, the striking end or tip end 26 of the cue 24 incorporates a material of a second kind selected from a pair of materials that are mutually engaged and retained against one another. The chalk cube 28 incorporates a material of the first kind of the pair of materials referred to above. Thus, when the player 22 brings the striking end 26 of cue 24 against the chalk cube 28, they are engaged and retained by one another. Thus the player 22 can withdraw his cue 24 and with his free hand (in this case his left hand) pick the chalk cube 28 from the tip end 26 and condition the cue tip with the chalk for further play.

In the preferred embodiments of the invention, the material of the first kind is a paramagnetic material of low retentivity and the material of the second kind is a permanent magnet material, that is a material of high retentivity. The advantages of this combination of mutually attracted, engaged and retained materials in the cue tip area 26 and the chalk cube 28 are manifest. Heretofore, a player has either carried a chalk cube in a pocket with consequent inconvenience and clothing soilage or has employed some device attached to the player or his clothing which has the same problems of inconvenience and soilage. In the alternative, the player must walk around the table 10 to reach the chalk cube and utilize it for conditioning his cue and then return to the point where he wishes to take his next shot.

In alternate embodiments of the invention, the tip 26 incorporates a magnetic material of the first kind, that is a paramagnetic material, and the chalk cube 28 incorporates a magnetic material of the second kind, that is a permanent magnetic material. Other alternate embodiments can use magnetic materials of the second kind in both the cue and cube or involve materials other than magnetic materials that are considered less desirable and beneficial. These include an embodiment where the materials of the first and second kind are not magnetic but may, for example, be hook materials and loop materials, respectively, in a Velcro-type combination. In nonmagnetic embodiments of the invention, the interplay between the materials of the first kind and the material of the second kind generally is not one of attraction but only one of engagement and retention, which may be adequate to satisfy the requirements of some applications.

Figure 2:
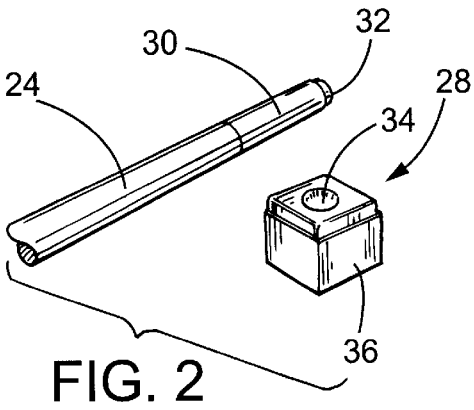
FIG. 2 is a diagrammatic view of the system including the striking end of a cue and a chalk cube.

FIG. 2 illustrates the two components of the preferred system shown in FIGS. 5–11. A fragment of the cue stick 24 is shown with a ferrule 30 and a tip 32 formed of leather or the like. The second component of the system, chalk cube 28, is of a chalk material and has a concave recess 34 in the top surface and a protective cover and magnetic material 36 on each of the four side surfaces. It is also desirable to have a protective cover on the bottom surface of the cube 28 to avoid soiling the hands and clothing of the user. The cover may be a coating or formed of sheet material.

Figure 3:
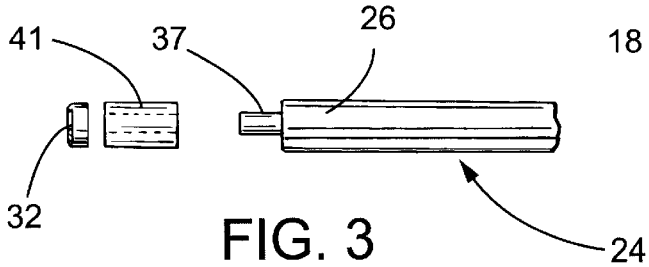
FIG. 3 is a general illustration of the striking end of a cue including a generalized illustration of the ferrule and tip forming a part thereof.

The tip or striking end 26 of a pool cue 24 is shown generally in FIG. 3. The striking end 26 of the cue shaft generally has a reduced portion comprising a tennon 37 to facilitate assembly with a cylindrical ferrule 41. The outer diameter of tennon 37 is generally selected to form a slight interference fit with the inner circumference of the ferrule 41 rendering the assembly relatively permanent while facilitating replacement of the ferrule 41 with different ferrules having different sizes, shapes, materials or internal configurations. The ferrule and tennon may also be cemented together or correspondingly threaded depending on the designer's choice. The instant invention is readily implemented in any of the common configurations of shafts, ferrules and tips. A leather tip 32 is secured on the tip end of ferrule 41 by one of various available techniques and procedures. Commonly the tip 32 is cemented on the tip end of ferrule 41. In other well-known pool cue constructions, the tip is secured to a pin-like support with a flat head to which the tip 32 is cemented and a threaded shaft engaging corresponding threads in a ferrule 41 (not shown). The ferrule may be constructed of various materials including cast polymers, machined aluminum, steel or brass or any material having the desired appearance, strength and workability. In implementing various embodiments of this invention, the selection of ferrule material is governed in part by the desired magnetic characteristics of the system. Various configurations of the components of the systems to implement the methods, structures and advantages of the invention are shown and described with respect to FIG. 4 et seq.

Figure 4:
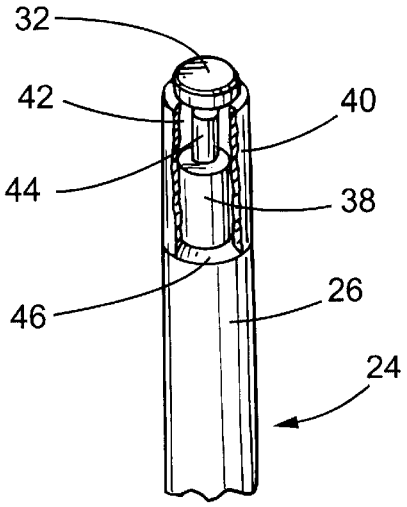
FIG. 4 illustrates the striking end of a pool cue with the ferrule partially broken away illustrating one preferred embodiment of the invention.

As shown in FIG. 4, the ferrule 40 is broken away in order to illustrate the internal configuration thereof. The ferrule 40 is secured to the tip end 26 of the cue shaft on the distal surface 46 with the tennon 38 extending into the ferrule. The ferrule 40 may be secured to the tennon 38 by a force fit or by the use of an adhesive or cement. The ferrule may also be internally threaded to match threads on the tennon providing a screw on and off connection that expedites replacement of ferrules. In the embodiment of FIG. 4, the tip 32 of leather or the like is cemented to the tip end of the ferrule defining a space 42 between the tip end of the tennon 38 and the leather tip 32. Disposed within the space 42 is a permanent magnet 44 that may be selected from any suitable magnetic material of the second kind and formed in an appropriate configuration to fit the space 42. The magnet 44 is secured to avoid motion and any associated sound that would be irritating to the player. This may be accomplished by shaping the ferrule to support the magnet or providing a central opening in the ferrule 40 or in the tennon 38 to receive the permanent magnet 44 either in a forced fit or with a cement material. The magnet 44 is a material of the second kind as referred to above, that is, it is a permanent magnet. It is selected to have sufficient flux and attractive force to attract, engage and retain a chalk cube such as chalk cube 28 such as shown in FIG. 2 having paramagnetic material incorporated therein. The paramagnetic material is preferably soft iron or steel in a sheet form with minimum thickness and low magnetic retentivity as will be described hereinafter.

With respect to the permanent magnet 44, a magnetic material of the second kind, it can be fabricated from a variety of raw materials. This includes ferrite magnets made of hard ceramic material which are low cost but have a relatively low magnetic reading for a given size and configuration compared to other magnets. Other choices include alnico magnets made from aluminum, nickel and cobalt which provide higher flux density than ferrites and a magnetic reading roughly twice that of the ferrites. The magnetic materials of choice include samarium cobalt magnets that provide flux strength several times that of alnico and are less fragile than sintered magnetic materials. Magnets of 'neo' are preferred for the instant invention as they have magnetic readings higher than the samarium cobalt and much higher than alnico or ferrite magnets. The neodymium iron boron magnets (NdFeB or Neo) are sintered and thus, like other sintered materials, must be utilized and processed with care. The magnet 44 in FIG. 4 can be surrounded with retaining material or have a configuration to fully occupy the space above tennon 38. In the embodiment shown in FIG. 4, the ferrule may be turned aluminum of a conventional outer diameter of about one-half inch with thin walls. A neo magnet that has functioned very adequately in the embodiment of FIG. 4 is one-quarter inch in diameter and one-half inch long. If the ferrule 40 is fabricated in a molded polymer, the magnet 44 may be cast as an insert in the molding process.

Figure 5:
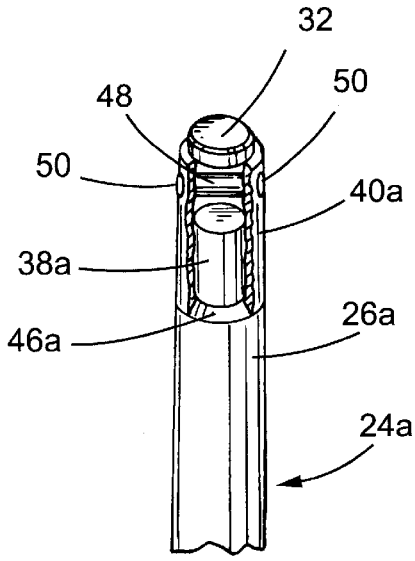
FIG. 5 illustrates the striking end of another preferred embodiment of the cue portion of the system of this invention.

In the embodiment of FIG. 5, the tip end 26*a* of the cue shaft may be similar to that shown in FIG. 4 with a similar ferrule 40*a* supported on the distal surface 46*a* and sized for a forced fit on the tennon 38*a*. In the embodiment of FIG. 5, a neo magnet 48 is mounted in the ferrule 40*a* transverse to the axis of the cue 24*a*. In the FIG. 5 embodiment, the ferrule 40*a* is a turned aluminum tube that receives the magnet 48 in a pair of apertures 50 formed in the ferrule 40*a*. The dimensions of the apertures 50 and the magnet 48 are selected to provide a forced fit which must be carefully selected to avoid damage to the magnet 48 which may be of a sintered, and thus fragile, material. If the ferrule 40*a* has a ½ inch diameter, a magnet slightly less than one-half inch long and one-quarter inch in diameter is preferred. The slight recesses remaining in the ferrule at the apertures 50 may be filled with decorative contrasting colored material or otherwise treated for appearance. The space adjacent the tip 32 and beyond the end of the tennon 38*a* can be filled with filler material for support and stability as well as ease of manufacture. In the event that the ferrule 40*a* is a cast polymer, the magnet 48 can be an insert in the mold and if desired be totally contained within the outer surface of ferrule 40*a*, eliminating the openings 50. The configuration of FIG. 5 is the preferred embodiment because the force of the magnetic field is optimized with the magnet, and thus the magnetic field, transverse in the ferrule.

It has been found that an appropriate chalk cube incorporating magnetic material of the first kind, that is paramagnetic or nonpermanent magnetic material, will be attracted from a remote location to the tip end of the cue 26*a* and will be retained with substantial force against the cue.

Figure 6:
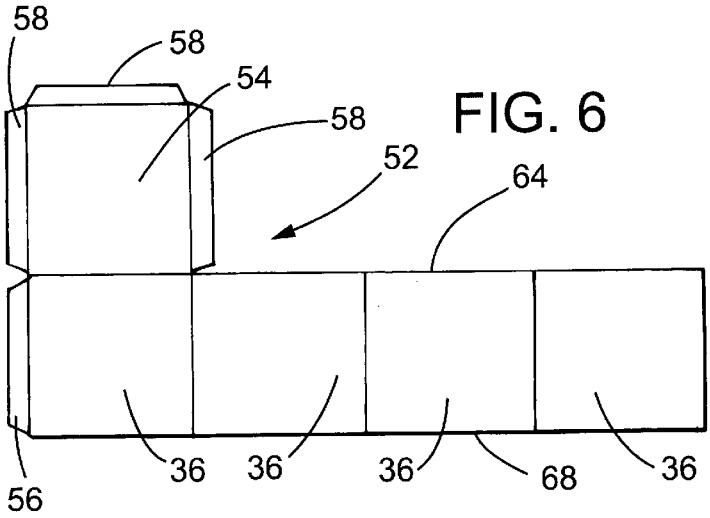
FIG. 6 is a plan view of one wrapper for a chalk cube in accordance with this invention.

One preferred decorative wrapper or cover 52 for a chalk cube is shown in FIG. 6. The wrapper can be of any fairly hard paper material with reasonable abrasion resistance and printed for trade identification and aesthetics on the four sides 36 as well as the bottom 54. Depending upon the selection of the wrapper material for weight and stiffness, the wrapper 52 may include a side tab 56 and bottom tabs 58 to insure a more positive, durable and aesthetic product.

Figure 7:
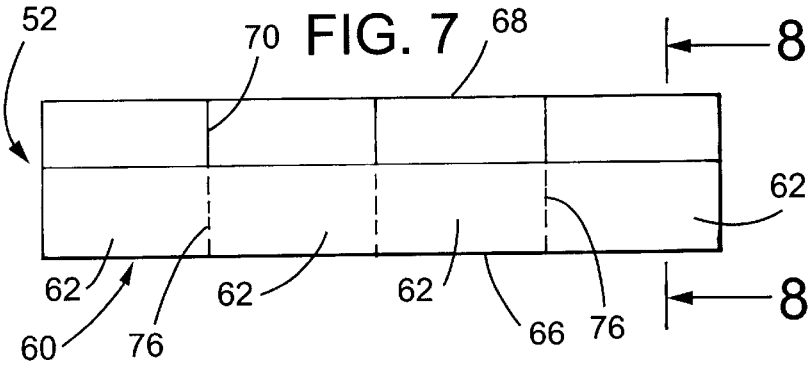
FIG. 7 is a view of a portion of the wrapper of FIG. 6 laminated with a strip of paramagnetic material.

In one assembly of the chalk cube 28 of FIG. 2 a sheet of thin soft iron or steel material 60 is fabricated as shown in FIG. 7. The sheet has four side panels 62 which will conform with and be secured to the four sides 36 of wrapper 52. The wrapper 52 is shown inverted in FIG. 6 with the bottom panel 54 at the top. In assembly, the edge 64 of wrapper 52 aligns with edge 66 of iron sheet 60. The top edge 68 of wrapper 52 extending above the plate 60. The total height of the wrapper 52 in one preferred embodiment is about ⅞th of an inch leaving exposed chalk above the top edge 68. The tabs 56 and 58 and bottom 54 are not required and are not shown in FIG. 7 for ease of understanding and for convenience. In assembly, the plate 60 is first secured to the wrapper 52 by a thin layer of adhesive. Thereafter the combination of wrapper 52 and plate 60 is folded along the lines 70 to conform to a one-inch chalk cube with adhesive securing both the plate 60 and wrapper 52 to the cube. The plate 60 may be scored along score lines 76 to facilitate forming and assembly of the wrapper and plate on the chalk cue and to provide formation of the end product with greater precision and sharper corners.

Figure 8:
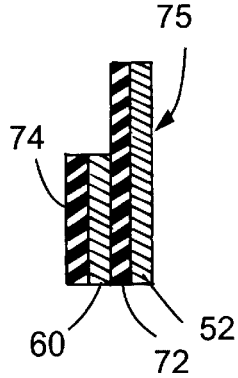
FIG. 8 is a diagrammatic enlarged cross sectional view taken on the line 8—8 of FIG. 7 greatly exaggerated to illustrated its configuration.

In FIG. 8, a sectional side view of the combination of FIG. 7 is shown greatly exaggerated. As shown in FIG. 8, the plate 60 is first secured to the wrapper 52 with a layer of adhesive 72. On the other side or outer side of plate 60 a layer of adhesive 74 is applied whereafter the entire laminated structure 75 is secured by adhesive 72 and 74 to the chalk cube. As mentioned, the cross section of FIG. 8 is greatly exaggerated. In one preferred embodiment the plate 60 is a 0.008 inch (8 mil) plate and the wrapper 52 of a similar or lesser dimension. The cement layer 72 and 74 are also greatly exaggerated for clarity.

An alternative embodiment of the system of this invention is a combination of the cue 24 assembled with a ferrule 30 fabricated from a low retentivity steel or other paramagnetic material. The cue with a steel ferrule is combined with a chalk cube incorporating permanent magnetic material such as cube 78 of FIG. 9. The cube 78 has the concave cavity 80 but is formed with a permanent magnet 82 cast inside of the chalk. The magnet 82 may be of the general dimensions described above, namely approximately one-half inch long and one-quarter inch in diameter and may be of a magnetic material of the second kind. The cube 78 of FIG. 9 can be wrapped in a wrapper substantially the same as or identical to the wrapper 52 of FIG. 6.

Figure 10:
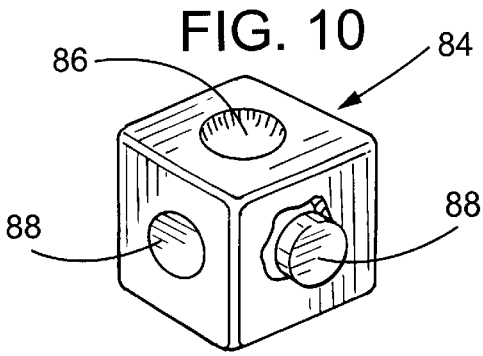
FIG. 10 illustrates another chalk cube constructed in still another embodiment of the invention.
Figure 9:
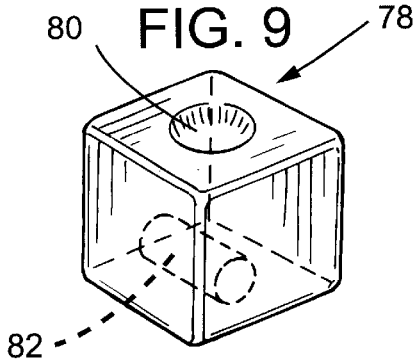
FIG. 9 illustrates a chalk cube constructed in accordance with another embodiment of the invention.

Another embodiment of the chalk cube portion of the alternate combination is shown in FIG. 10 where the cube 84 may have a concave cavity 86 for interfacing with the cue tip and one or more small permanent magnets of material of the second kind such as magnets 88. Such magnets may be recessed into the chalk in the formation process and the sides and bottom covered with a wrap such as the wrapper 52 of FIG. 6.

Figure 11:
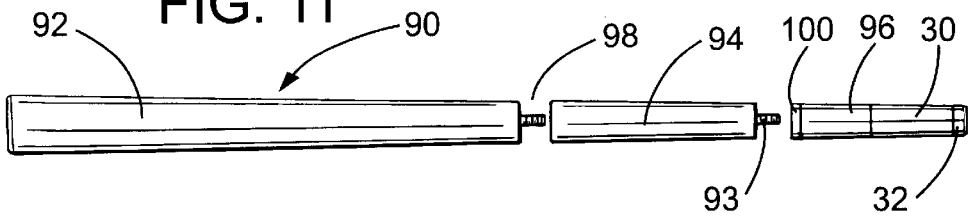
FIG. 11 is an exploded view of a pool cue constructed with threadably engagable sections for easy transportation and incorporating the invention.

Finally, FIG. 11 shows an alternate cue construction in which the cue body 90 is made in multiple sections 92, 94 and 96 which are secured together by threaded interfaces 93 and 98. The assembled cue is of conventional length, size and weight but is disassembled for easy transportation. The cue of FIG. 11 may be provided with an annular-shaped permanent magnet 100 in which the faces are the magnetic poles. The cue 90 functions in combination with the cube 28 of FIG. 2 having soft iron side plates 62. In all other respects the system comprising the cue of FIG. 11 and the cube of FIG. 2 functions as already described. However, the magnetic attraction of the cue and cube are maximized at a more distant position from but still in proximity to the tip 32. In other embodiments a multi-section cue may employ any of the systems of FIGS. 4–10.

All references to patents cited herein are hereby incorporated by reference to the same extent as if each reference were individually and specifically indicated to be incorporated by reference and were set forth in their entirety herein.

The use of the terms "a" and "an" and "the" and similar references in the context of describing the invention (especially in the context of the following claims) are to be construed to cover both the singular and the plural, unless otherwise indicated herein or clearly contraindicated by context. Recitation of values and ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") used herein, is intended merely to better explicate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend that the invention may be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A system utilizing a pool cue for recovering a chalk body from a remote location in a pool table environment comprising:

a pool cue including a tapered shaft having a gripping end of relatively large cross section and a striking end of relatively small cross section, a tip mounted on the striking end of the shaft, and material of one of two kinds incorporated within said shaft in proximity to said tip;

said two kinds comprising a first kind including magnetic material and a second kind including permanent magnetic material having substantial retentivity and field strength; and a chalk body incorporating material of the other of said two kinds.

2. A system according to claim 1 wherein said material incorporated in said shaft is of the second kind and said material incorporated in said chalk body is of the first kind.

3. A system according to claim 1 wherein said material incorporated in said shaft is material of the first kind and said material incorporated in said chalk body is material of the second kind.

4. A system according to claim 2 wherein the material in said shaft is a body of sintered ferromagnetic material and the chalk body is a cube having faces and said material in said chalk body is a thin magnetic sheet on a portion of said faces.

5. A system according to claim 2 including a non-magnetic ferrule between the striking end of the shaft and the tip, the material incorporated with the shaft being disposed in said ferrule.

6. A system according to claim 5 wherein said material in said ferrule is a cylinder having a magnetic field along the cylinder axis.

7. A system according to claim 6 wherein the cylinder has its axis transverse to the axis of the ferrule.

8. A system according to claim 7 wherein a thin magnetic sheet overlies a portion of said chalk body.

9. The system of claim 8 wherein a wrapper covers the magnetic sheet material on said chalk body.

10. A system utilizing a pool cue for recovering a chalk body from a remote location in a pool table environment comprising:

a pool cue including a tapered shaft having a gripping end of relatively large cross section and a striking end of relatively small cross section, a tip mounted on the striking end of the shaft, and a permanent magnet incorporated with said shaft in proximity to said tip; and a chalk body incorporating magnetic material.

11. A pool cue comprising:

a tapered shaft having a gripping end of relatively large cross section and a striking end of relatively small cross section;

a tip mounted on the striking end of the shaft;

a ferrule between the striking end of the shaft and the tip; and a permanent magnet incorporated with said shaft in proximity to said tip, said magnet being disposed in said ferrule.

12. A pool cue according to claim 11 wherein the material in said ferrule is a cylinder having a magnetic field along the cylinder axis.

13. A pool cue according to claim 12 wherein the cylinder has its axis transverse to the axis of the ferrule.

14. A pool cue according to claim 11 wherein said magnet is a body of sintered ferromagnetic material.

* * * * *

UNITED STATES PATENT AND TRADEMARK OFFICE

CERTIFICATE OF CORRECTION

PATENT NO. : 6,726,573 B2
DATED : April 27, 2004
INVENTOR(S) : Jesse J. Edge

It is certified that error appears in the above-identified patent and that said Letters Patent is hereby corrected as shown below:

Title page,
Item [57], ABSTRACT,
Line 7, delete “paramagnetic” and insert -- magnetic --

Column 1,
Line 58, after “purpose”, insert -- a chalk body such as --
Line 59, after “player” insert -- The chalk body may vary in size and shape. --

Column 2,
Line 41, after “recovery of” insert -- a chalk by such as --
Line 46, delete “cube” and insert -- body --
Line 62, delete “paramagnetic” and insert -- magnetic --

Column 3,
Lines 24 and 47, delete “paramagnetic” and insert -- magnetic --

Column 4,
Line 19, delete “paramagnetic” and insert -- magnetic --
Line 35, delete “that is a paramagnetic material”
Line 45, delete “in a Velcro-type combination” and insert -- as in the well known hook and loop VELCRO® Products.” --

Column 5,
Lines 55 and 56, delete “paramagnetic” and insert -- magnetic --

Column 6,
Line 51, delete “magnetic”
Lines 51-52, delete “paramagnetic or nonpermanent”

UNITED STATES PATENT AND TRADEMARK OFFICE

CERTIFICATE OF CORRECTION

PATENT NO. : 6,726,573 B2
DATED : April 27, 2004
INVENTOR(S) : Jesse J. Edge

It is certified that error appears in the above-identified patent and that said Letters Patent is hereby corrected as shown below:

Column 7,
Line 18, delete “cue”
Line 35, delete “paramagnetic” and insert -- magnetic --

Signed and Sealed this

Thirty-first Day of August, 2004

JON W. DUDAS
*Director of the United States Patent and Trademark Office*